US005812095A

United States Patent [19]

Adrian et al.

[11] Patent Number: 5,812,095

[45] Date of Patent: Sep. 22, 1998

[54] MOUNTING STRUCTURE FOR COMBINED AUTOMOTIVE TRIM ACCESSORY AND ANTENNA

[75] Inventors: Andrew Adrian, Dexter; Timothy Joseph Talty, Trenton; Bruce Robert Jones, Romulus; Tamara Jean Nordstrom, Bloomfield Hills, all of Mich.

[73] Assignee: Ford Motor Company, Dearborn, Mich.

[21] Appl. No.: 540,114

[22] Filed: Oct. 6, 1995

[51] Int. Cl.[6] ..... H01Q 1/32

[52] U.S. Cl. ..... 343/713; 343/744; 343/906

[58] Field of Search ..... 343/711, 712, 343/713, 715, 906, 742, 744; 248/539

[56] References Cited

U.S. PATENT DOCUMENTS

| | | | |
|---|---|---|---|
| 2,923,813 | 2/1960 | Davis | 343/712 |
| 4,169,575 | 10/1979 | Stefano | 343/713 |
| 4,209,788 | 6/1980 | Plantier | 343/713 |
| 4,329,691 | 5/1982 | Prewitt | 343/713 |
| 4,535,336 | 8/1985 | Shaver | 343/713 |
| 4,707,700 | 11/1987 | Nagy | 343/700 |
| 4,721,963 | 1/1988 | Nagy et al. | 343/712 |
| 4,737,795 | 4/1988 | Nagy et al. | 343/712 |
| 4,760,402 | 7/1988 | Mizuno et al. | 343/713 |
| 4,769,655 | 9/1988 | Nagy et al. | 343/712 |
| 4,866,453 | 9/1989 | Nagy et al. | 343/712 |
| 5,012,255 | 4/1991 | Becker | 343/704 |
| 5,106,141 | 4/1992 | Mostashari | 296/24.1 |
| 5,124,714 | 6/1992 | Harada | 343/713 |
| 5,177,493 | 1/1993 | Kawamura | 343/711 |
| 5,177,494 | 1/1993 | Dorrie et al. | 343/711 |
| 5,400,042 | 3/1995 | Tulintseff | 343/727 |
| 5,442,368 | 8/1995 | Harada et al. | 343/744 |

FOREIGN PATENT DOCUMENTS

| | | | |
|---|---|---|---|
| 1127511 | 12/1956 | France | 343/713 |
| 1200425 | 12/1959 | France | 343/713 |

*Primary Examiner*—Hoanganh T. Le
*Assistant Examiner*—Tan Ho
*Attorney, Agent, or Firm*—Mark Mollon

[57] ABSTRACT

A vehicular radio reception antenna is concealed within a body trim piece such as a spoiler or a luggage rack. A supporting body panel is utilized as a ground plane and a conductive loop is concealed within the trim piece. A transmission line connects two opposite sides of the resulting slot. Capacitors are used to connect the conducting loop to the sheet metal ground plane in order to form a dual slot/monopole antenna for receiving both FM and AM signals. An integrated mounting structure provides both mechanical and electrical connection of the trim piece and antenna in a single integrated assembly part.

3 Claims, 4 Drawing Sheets

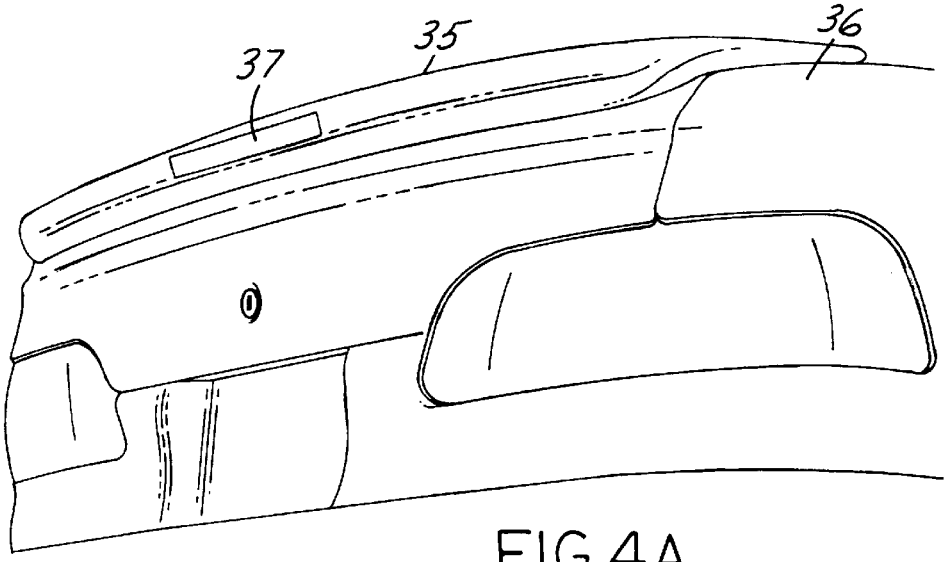
FIG. 4A
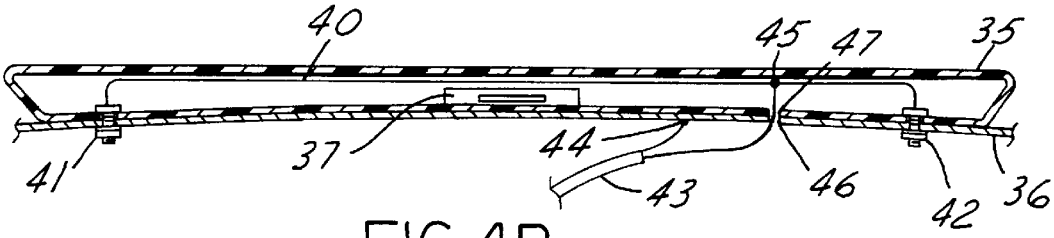
FIG. 4B
FIG. 5
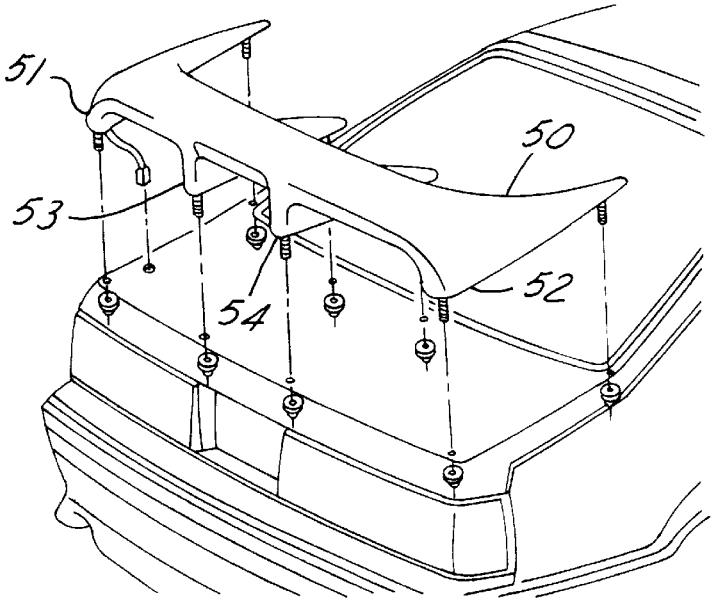

MOUNTING STRUCTURE FOR COMBINED AUTOMOTIVE TRIM ACCESSORY AND ANTENNA

BACKGROUND OF THE INVENTION

This application is related to application U.S. Ser. No. 08/540,113 now U.S. Pat. No. 5,629,712, entitled "Vehicular Slot Antenna Concealed in Exterior Trim Accessory", filed concurrently herewith and incorporated herein by reference.

The present invention relates in general to a concealed antenna for use on a vehicle, and more specifically to an integrated mounting and electrical connection structure for an exterior trim accessory, such as a spoiler, that conceals an antenna.

The most commonly used type of antenna for radio reception in automotive vehicle has been the standard whip antenna. The whip antenna has been desirable because of its good antenna performance in terms of antenna gain and directionality. Nevertheless, automotive manufacturers have sought alternatives to whip antennas because whip antennas are susceptible to damage (e.g., being bent or broken off), create wind noise, and are unattractive from a styling standpoint. However, concealed antenna designs which provide performance comparable to whip antennas and which may be made at a low cost have remained elusive.

The slot antenna is one type of concealed antenna that has been employed on automotive vehicles. A slot may be formed by a window aperture or by special composite materials used for body panels. Slot antennas, however, have not been well suited to reception in more than one frequency band. In slot antenna design, a slot is provided with a length about equal to one half the wavelength of the desired radio signals to be received. Thus, a single slot antenna is not well suited to receive both AM and FM radio signals because of the great difference between AM and FM wavelengths. Multiple slot antennas can be provided to obtain reception in multiple frequency bands, but a multiple slot design results in increase cost. Likewise, slot antenna designs employing body panels formed of composite materials are relatively expensive.

An on-glass antenna is another type of conformal (i.e., concealed) antenna. Antenna conductors are typically deposited on glass sheets in patterns that form separate FM and AM antennas. Typically, the AM antenna conductors also function as the heater grid for the glass window. However, in order to combine the AM and FM signal onto one transmission line to the radio receiver, special electronics are required to isolate the AM signals from the heater grid power voltage and to introduce the AM and FM signals to the coaxial transmission line. These special electronics typically require an additional electronic module and result in increased expense.

Related application Ser. No. 08/540,113 discloses a dual slot/monopole antenna concealed within a spoiler, whereby good antenna performance and low manufacturing cost is obtained. The low cost advantage of the antenna is furthered according to the present invention which provides integrated structures for mechanically mounting the trim accessory and electrically connecting the antenna.

SUMMARY OF THE INVENTION

The present invention has the advantages of providing simplified and lower cost parts and manufacturing processes for concealing an antenna within an exterior trim accessory. The mounting structure also provides an integral capacitor element.

In one aspect, the invention provides an attachment structure for a dual slot/monopole antenna having a conducting loop passing through an exterior trim piece mounted on a sheet metal body panel of a vehicle. An electrically conducting bolt has a bolt head bearing against the exterior trim piece and has a shaft passing through the sheet metal body panel. The bolt head has the conducting loop electrically attached thereto. An insulating washer is retained on the shaft bearing against the sheet metal body panel and electrically insulating the bolt from the sheet metal body panel. An electrically conducting nut is retained on the shaft and bears against the insulating washer. The electrically conducting nut overlaps an area of the sheet metal body panel and is separated from the sheet metal body panel by the insulating washer in order to form a capacitor providing an electrical connection between the conducting loop and the sheet metal body panel for predetermined radio frequency signals.

In another aspect of the invention, an attachment structure for a dual slot/monopole antenna has a conducting loop passing through an exterior trim piece mounted on a sheet metal body panel of a vehicle. The antenna has a transmission line having a first conductor coupled to the sheet metal body panel and a second conductor coupled to the conducting loop. An electrically conducting bolt has a bolt head bearing against the exterior trim piece and has a shaft passing through the sheet metal body panel. The bolt head has a first end of a signal conductor electrically attached thereto. A second end of the signal conductor is connected to the conducting loop. An insulating washer is retained on the shaft, bears against the sheet metal body panel, and electrically insulates the bolt from the sheet metal body panel. An electrically conducting nut is retained on the shaft and bears against the insulating washer. A first conductive washer is retained between the insulating washer and the sheet metal body panel. The first conductive washer is connected to the first conductor. A second conductive washer is retained between the insulating washer and the electrically conducting nut. The second conductive washer is connected to the second conductor.

BRIEF DESCRIPTION OF THE DRAWINGS

FIG. 4A is a perspective view of an alternative spoiler embodiment.

FIG. 4B is a cross-sectional view of the spoiler of FIG. 4A having the antenna mounted therein.

FIG. 5 is a perspective view of another spoiler embodiment.

DETAILED DESCRIPTION OF PREFERRED EMBODIMENTS

Vehicular slot antennas are discussed in commonly assigned U.S. patent application Ser. No. 08/118,856, entitled "Slot Antenna with Reduced Ground Plane", filed Sep. 10, 1993 now abandoned, which is hereby incorporated by reference. The application teaches that while the surface area of the ground plane of a slot antenna is typically much greater than the slot area, slot antenna action can be obtained with a reduced-size ground plane. Thus, a reduced ground plane antenna comprises a loop of narrow conductive strip in a rectiform shape on a surface of a glass sheet. Antenna terminals are located on opposite sides of the reduced ground plane slots for feeding the slot antennas within the glass sheet.

Figure 1:
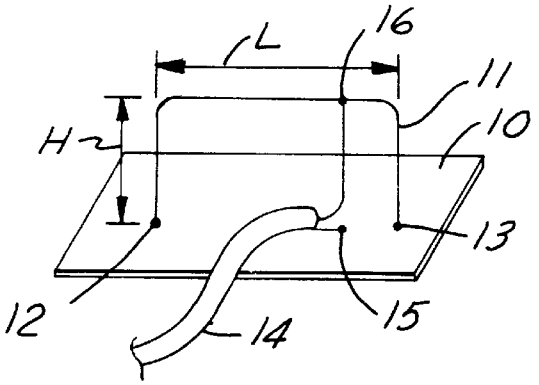
FIG. 1 is a perspective view of the antenna structure of the present invention.

Turning to FIG. 1, the slot antenna of this invention is shown to be constructed in three dimensions. A conductive ground plane 10 supports a conductive loop 11 extending above ground plane 10 between a first point 12 and a second point 13 thereby creating a slot area. Rather than being contained entirely within the plane of ground plane 10, the slot area is formed within the area circumscribed by conducting loop 11 and a line within ground plane 10 extending between points 12 and 13. The slot has a length L and a height H. A transmission line 14 (such as a coaxial cable) has first and second conductors connected to opposite sides of the slot. For example, transmission line 14 has a shield conductor connected to a third point 15 within ground plane 10 and a center conductor connected to a fourth point 16 in conductive loop 11. The position of points 15 and 16 along the length of the slot are selected to provide the necessary antenna impedance, as is known in the art. The impedance increases as point 16 is moved farther away from the edge of the slot. The length L of the slot is selected to be approximately about ½ wavelength in the desired frequency band to be received by the antenna. For example, FM signals are broadcast between 88 and 108 MHz and ½ wavelength corresponds to about 1.5 meters.

Figure 2:
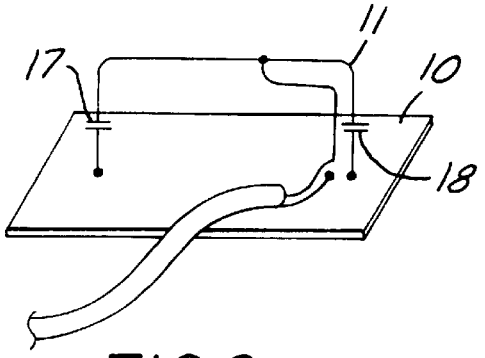
FIG. 2 is a perspective view showing the addition of capacitors to the antenna of the invention.

The slot antenna of FIG. 1 with a slot length adapted to receive FM signals would be insensitive to AM signals since the longer wavelengths of AM signals would not excite the slot and would be lost to the ground plane. In an alternative embodiment as shown in FIG. 2, a pair of capacitors 17 and 18 are inserted between conducting loop 11 and ground plane 10. The capacitance of the capacitors is selected to provide a low impedance at FM frequencies so that they have no impact on antenna performance at FM frequencies. However, the capacitance is selected to provide a high impedance at AM frequencies (530 to 1710 kHz) to isolate AM signals in the conducting loop from the ground plane, thereby obtaining antenna performance as a monopole at AM frequencies. The capacitance may be equal to about 100 picoFarads, for example.

The present invention is especially adapted to be concealed in an automotive vehicle. For a body trim piece (such as a spoiler, a luggage rack, or a roof rack) elevated over a body sheet metal part, the antenna of the invention can be implemented using a minimum of additional parts and at a low cost.

Figure 3A:
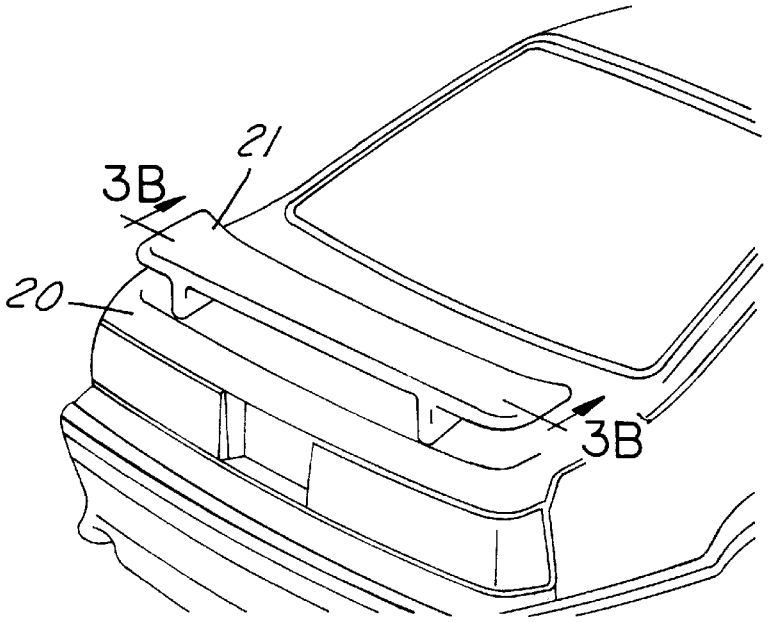
FIG. 3A is a perspective view of a spoiler.
Figure 3B:
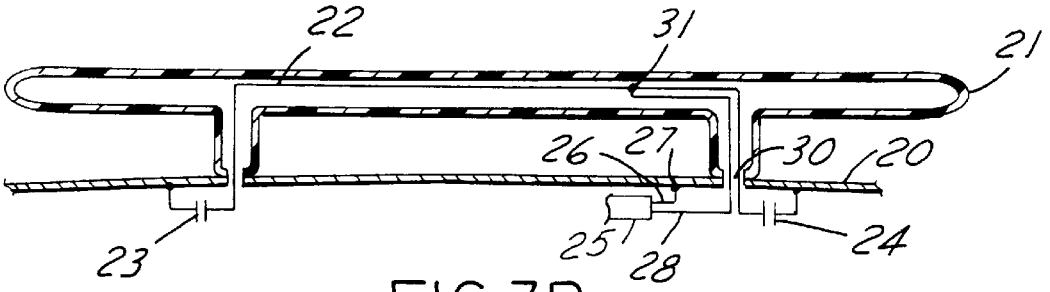
FIG. 3B is a cross-sectional view of a spoiler including the antenna of the invention.

FIG. 3A shows a perspective view of a wing-shaped spoiler for concealing the antenna of the present invention. A deck lid 20 supports a spoiler 21 such that the deck lid sheet metal provides a ground plane and the spoiler provides a location for concealing the conducting loop forming the slot. FIG. 3B shows the deck lid sheet metal 20 and spoiler 21 in cross-section. Conducting loop 22 is connected to the body sheet metal through capacitors 23 and 24. A coaxial transmission line 25 has a shield conductor 26 connected to sheet metal 20 at a point 27. Coaxial cable 25 has a center conductor 28 passing through a hole 30 in sheet metal 20 into the interior of spoiler 21 for connection with conducting loop 22 at a point 31.

FIG. 4A shows a perspective view of another type of spoiler for implementing the present invention. Rather than being shaped as a wing, spoiler 35 provides a raised surface above deck lid 36 without any gaps therebetween. Spoiler 35 contains a high-mount stop lamp assembly 37. As shown in cross-section in FIG. 4B, a conducting loop 40 is disposed within spoiler 35 and is connected to spoiler mounting bolts 41 and 42 which also provide the electrical connection of conducting loop 40 to the sheet metal panel of deck lid 36. Bolts 41 and 42 may provide integral capacitors for implementing an AM/FM antenna, as described in the related application Ser. No. 08/540,113. A coaxial cable 43 has its shield conductor connected to sheet metal panel 36 at a point 44 and has its center conductor connected to conducting loop 40 at a point 45. The center conductor passes through a hole 46 in deck lid sheet metal 36 and a hole 47 in spoiler 35.

Typically, the transmission line is connected to the conducting loop fairly close to the side edge of the slot area (i.e., within several inches). Thus, there is little effect upon antenna performance whether the center conductor directly crosses the slot area as shown in FIGS. 1 and 4B or is routed along the side edge of the slot area as in FIGS. 2 and 3B. Likewise, there is little effect upon antenna performance whether the shield conductor of the transmission line is connected directly across the slot from the other connection point or is connected near one of the terminations of the conducting loop.

FIG. 5 shows yet another alternative embodiment of a spoiler. Spoiler 50 has side supports 51 and 52 and center supports 53 and 54, each support having associated mounting bolts. Separate mounting bolts can thus be used for implementing connections or the conducing loop and for the signal connection and ground connection of the transmission line.

Figure 6:
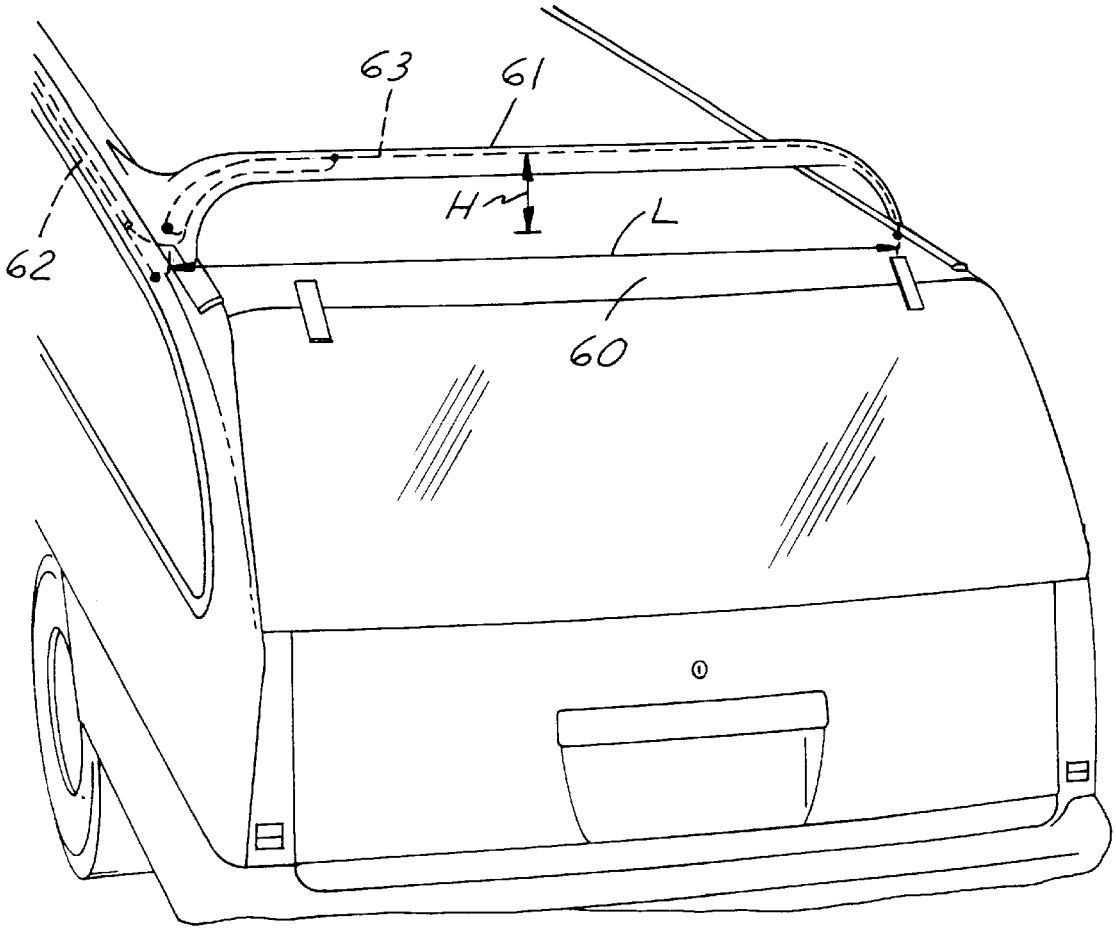
FIG. 6 is a perspective view showing a roof luggage rack and an antenna contained therein.

FIG. 6 shows an alternative embodiment wherein the antenna of the invention is concealed within a roof luggage rack. A roof sheet metal panel 60 provides a ground plane and a raised roof rack crosspiece 61 conceals a conducting loop. A coaxial cable 62 concealed within the roof structure has its shield conductor connected to the roof panel and has its center conductor connected to conducting loop 63 within crosspiece 61.

Spoilers and luggage or cargo racks are typically manufactured from plastic and are thus nonconductive. By minimizing the amount of metal around the top and sides of the slot, an omnidirectional antenna reception pattern is achieved.

Figure 7:
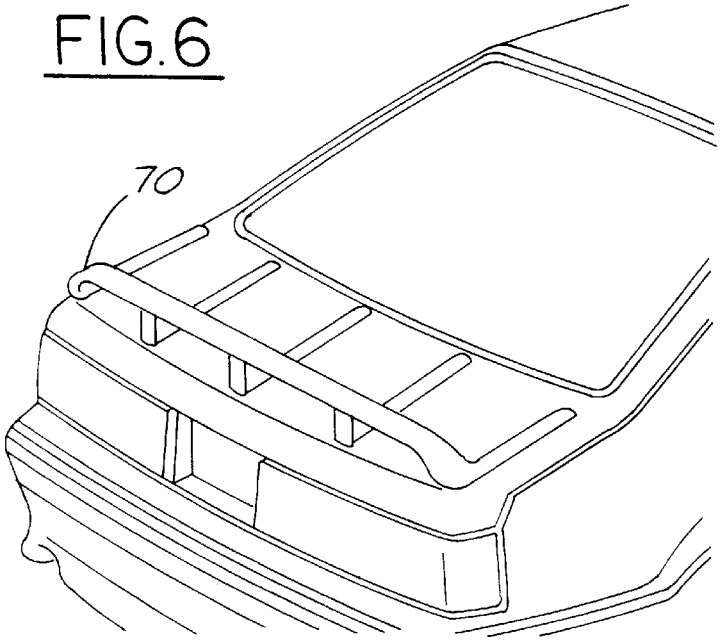
FIG. 7 is a perspective view showing a trunk mounted luggage rack.

In an alternative embodiment as shown in FIG. 7, the body trim piece may itself be formed of a conducting material. Thus, a luggage cage 70 having a metal structure is mounted on a deck lid 71. Cage 70 includes a raised horizontal conducting piece and at least a pair of vertical conducting pieces extending between the horizontal conducting piece and the deck lid sheet metal. The resulting slot may be connected to a transmission line as described in the previous embodiments.

Figure 8:
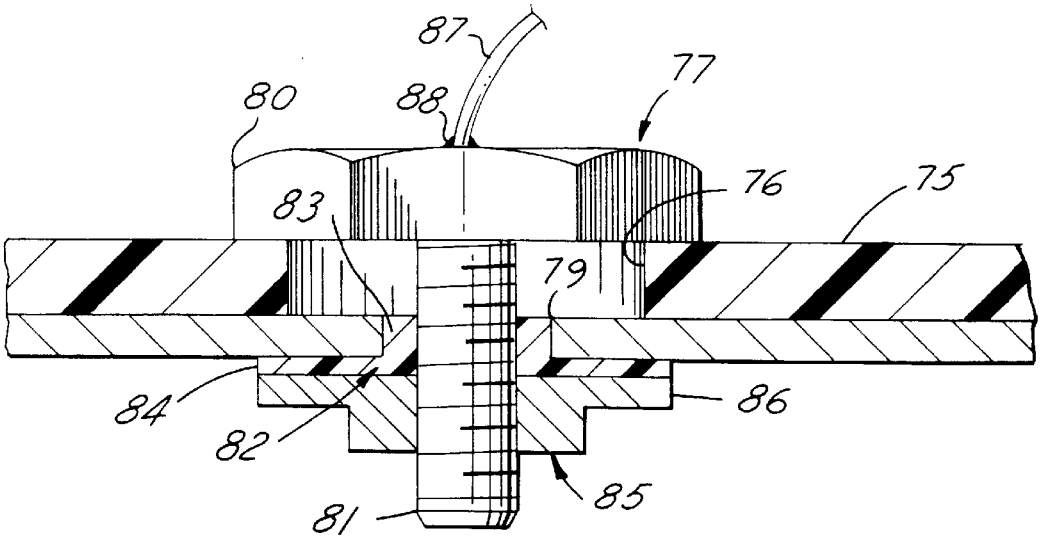
FIG. 8 is a cross-sectional view of a mounting structure including the conducting loop of the antenna.

Turning now to the mounting structures of the invention in more detail, FIG. 8 shows an attachment bolt for a spoiler or other trim piece in cross section. A spoiler lower surface 75 has an aperture 76 receiving a metallic bolt 77. The spoiler rests upon a deck lid sheet metal panel 78 having an aperture 79 aligned with aperture 76. Bolt 77 has a bolt head 80 and a threaded shaft 81. Bolt head 80 is captured in spoiler lower surface 75 and threaded shaft 81 passes through apertures 76 and 79.

A plastic washer 82 includes a sleeve 83 inserted over shaft 81 and a flange 84 bearing against sheet metal panel 78. A metal nut 85 is threaded onto shaft 81 and has a flange 86 bearing against flange 84. Plastic washer 82 is an electrical insulator and acts as a dielectric layer of a capacitor formed with flange 86 and sheet metal panel 78. A wire 87 for forming the conducting loop within the spoiler is electrically connected to bolt head 80 by a weld 88. Thus, both the mechanical support and attachment of the spoiler and the capacitive connection of the antenna conducting loop to the sheet metal panel are accomplished by an integrated assembly part.

The capacitance provided by the bolt structure depends upon the area of overlap A between metal nut 85 and sheet metal panel 78, the thickness of plastic washer flange 84, and the permittivity of the plastic. For example, using nylon plastic, a washer flange diameter of 60 mm, a washer flange thickness of 0.78 mm, and a sheet metal aperture with a diameter of 7 mm, a capacitance of about 117 picoFarads is obtained.

Figure 9:
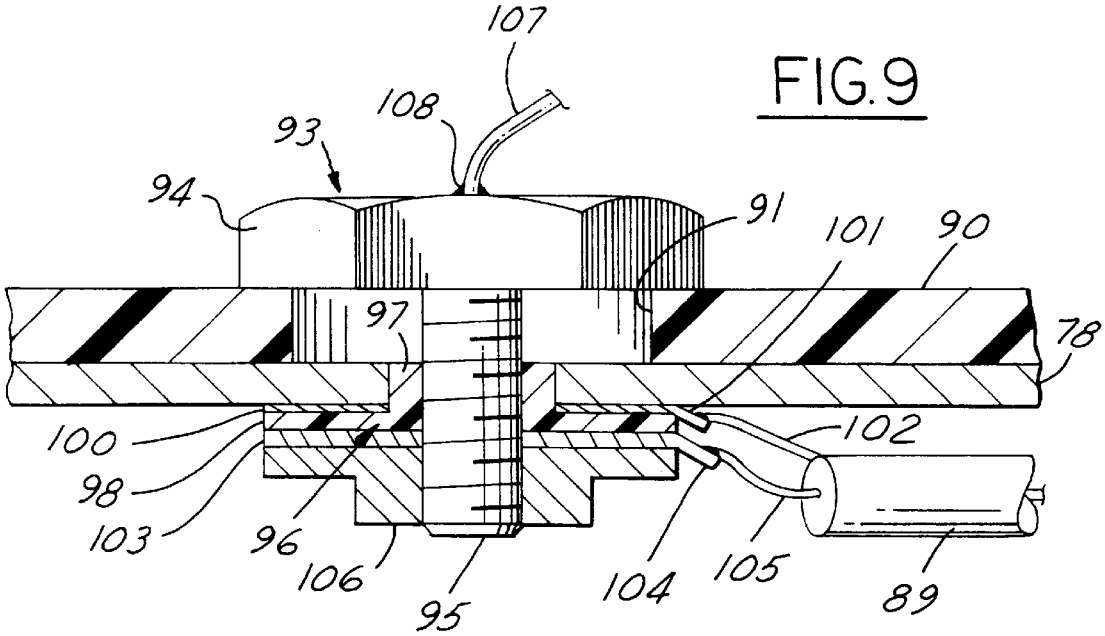
FIG. 9 is a cross-sectional view of a mounting structure including a ground connection for the antenna transmission line and for passing a signal line through to the interior of the trim piece.

FIG. 9 shows a mounting structure providing an integrated electrical connection for the antenna transmission line, shown as coaxial cable 89. A spoiler lower surface 90 has an aperture 91 receiving a metallic bolt 93. The spoiler rests upon deck lid sheet metal panel 78 having an aperture 92 aligned with aperture 91. Bolt 93 has a bolt head 94 and a threaded shaft 95. Bolt head 94 is captured in spoiler lower surface 90 and threaded shaft 95 passes through apertures 91 and 92.

A plastic washer 96 includes a sleeve 97 inserted over shaft 95 and a flange 98. A metal washer 100 is mounted between flange 98 and sheet metal panel 78 and bears against panel 78 to make an electrical connection. Metal washer 100 includes a soldering tab 101 that is soldered to shield conductor 102 of coaxial cable 89, thereby establishing the ground connection of the antenna transmission line.

A metal washer 103 is inserted on shaft 95 after plastic washer 96 and has a soldering tab 104 soldered to center conductor 105 of coaxial cable 89. A metal nut 106 is threaded onto shaft 95 which retains the washer in place and ensures good electrical connection 1) between washer 103 and bolt 93 and 2) between washer 100 and sheet metal panel 78.

A signal wire 107 is electrically connected to bolt 93 by a weld 108. The opposite end of signal wire 107 (not shown) is connected to the conducting loop of the antenna inside the spoiler, e.g., by splicing.

What is claimed is:

1. An attachment structure for a dual slot/monopole antenna having a conducting loop passing through an exterior trim piece mounted on a sheet metal body panel of a vehicle, said attachment structure comprising:

an electrically conducting bolt having a bolt head bearing against said exterior trim piece and having a shaft passing through said sheet metal body panel, said bolt head having said conducting loop electrically attached thereto;

an insulating washer retained on said shaft, said insulating washer bearing against said sheet metal body panel and electrically insulating said bolt from said sheet metal body panel; and an electrically conducting nut retained on said shaft and bearing against said insulating washer;

wherein said electrically conducting nut overlaps an area of said sheet metal body panel and is separated from said sheet metal body panel by said insulating washer in order to form a capacitor providing an electrical connection between said conducting loop and said sheet metal body panel for predetermined radio frequency signals.

2. The attachment structure of claim 1 wherein said electrically conducting nut includes a flange bearing against said insulating washer.

3. The attachment structure of claim 1 wherein said insulating washer is comprised of plastic.

* * * * *